United States Patent [19]

Matrot

[11] 4,014,364

[45] Mar. 29, 1977

[54] UNIVERSAL CIRCUIT-DEFINING DEVICE

[75] Inventor: Pierre Matrot, Fontenay-sous-Bois, France

[73] Assignee: Martonair Limited, Twickenham, England

[22] Filed: May 29, 1975

[21] Appl. No.: 581,736

[30] Foreign Application Priority Data

May 29, 1974 France ..... 74.18664

[52] U.S. Cl. ..... 137/271; 137/608

[51] Int. Cl.[2] ..... F15C 1/06

[58] Field of Search ..... 137/117, 271, 608; 235/201 ME

[56] References Cited

UNITED STATES PATENTS

| | | | |
|---|---|---|---|
| 3,407,834 | 10/1968 | Brandenberg | 137/271 |
| 3,631,881 | 1/1972 | Bowditch | 137/271 |
| 3,707,163 | 12/1972 | Hugler | 137/271 |
| 3,707,989 | 1/1973 | Jullien-Davin | 137/271 X |

*Primary Examiner*—Alan Cohan

*Attorney, Agent, or Firm*—Gifford, Chandler, Sheridan & Sprinkle

[57] ABSTRACT

A universal circuit-defining device with which logical or other component elements or modules of component elements are to be connected. The device includes a base plate having channels therein closed by a deformable seal held against the channels in the base plate by a cover plate, the channels constituting pre-established circuit elements and having sockets formed therein to receive interchangeable plugs constituting means for the interruption of the circuit and which are removable to bring the corresponding parts of the circuit into operation.

4 Claims, 9 Drawing Figures

UNIVERSAL CIRCUIT-DEFINING DEVICE

BACKGROUND OF THE INVENTION

The invention relates to apparatus defining a plurality of alternative fluid circuit configurations (hereinafter called a "universal circuit-defining device") and is particularly, but not exclusively, concerned with a universal circuit-defining device providing logical fluid circuits of the kind employed in fluidics.

DESCRIPTION OF THE PRIOR ART

Fluid circuits in use at the present time employ either separate component elements, or component elements grouped in modules, arranged to be connected to provide simple logical functions or component elements or modules which are so pre-connected as to provide complex functions which can only be modified to a small extent, if at all. An object of the present invention is to provide a universal circuit-defining device by which a fluid circuit can be modified rapidly in a simple manner.

One known fluid circuit-defining device comprises a base plate within which there is an arrangement of open channels closed by a common sealing joint formed by a deformable material held by a rigid plate and each blocked by partitions which are formed in the moulding of the base plate and are therefore destructible and cannot be re-used. The arrangement of the channels in the known device follows a standard network and therefore dictates the circuits which can be produced by the removal of partitions and the component elements that can be employed in a chosen circuit. A further object of the invention is therefore to provide a universal circuit-defining device by which these disadvantages are avoided.

SUMMARY OF THE INVENTION

According to the invention a universal circuit-defining device with which logical or other component elements or modules of component elements are to be connected includes a base plate having open channels provided in a face thereof, the channels being closable by a deformable seal to be held against the channels in the base plate by a cover plate, the channels constituting pre-established circuit elements and having sockets formed therein to receive interchangeable plugs constituting means for the interruption of the circuit and which are removable to bring the corresponding parts of the circuit into operation.

BRIEF DESCRIPTION OF THE DRAWINGS

Other characteristics and advantages of the invention will be more easily understood on reading the following description of a universal circuit-defining device in accordance with the invention given by way of example with reference to the accompanying drawings, in which.

DESCRIPTION OF THE PREFERRED EMBODIMENTS

Figure 2:
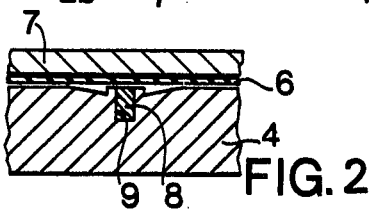
FIG. 2 is a sectional view along the line II—II in FIG. 1 and enlarged for clarity.
Figure 3:
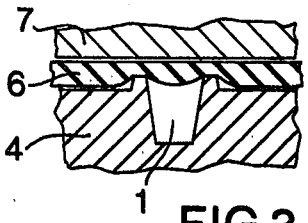
FIG. 3 is a sectional view along the line III—III in FIG. 1 and unlarged for clarity.
Figure 4:
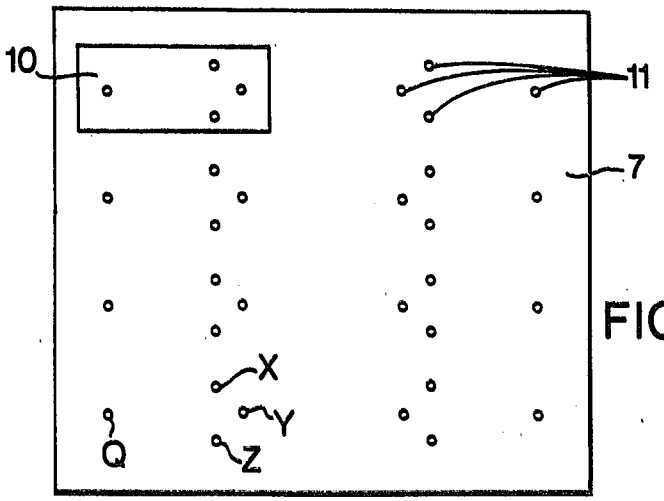
FIG. 4 is a schematic view of a circuit comprising eight NOR elements, using the device shown in FIGS. 1 to 3.

FIGS. 1, 2, 3 and 4 illustrate the construction of the device which comprises a base-plate 4 having in its upper face a plurality of open channels such as 1, 1*a*, 1*b*, 1*c*, 2, 2*a*, 2*b*, 2*c*, 3, 3*a*, 5, 5*a* formed therein. The channels may be made by moulding or casting the base-plate 4 or where the base-plate 4 is of metal, by engraving the upper surface of the base-plate 4. The arrangement of the channels is such that certain of the channels or certain portions of the channels can be selected and connected both together and also to logical component elements or modules to produce different logical functions. The upper edges of the channels are closed by a deformable sheet seal 6 (see FIGS. 2 and 3) which is held against the base-plate 4 by a cover plate 7 on which the logical component elements or modules 10 (see FIG. 4) are mounted. The plate 7 is formed with a formation or orifices 11 by which the component elements and modules 10 are connected by tubular pins pierced through the seal 6 and communicating with selected channels in the base-plate 4. Each channel is formed adjacent its ends or intermediately in its length with sockets 9 into which plugs 8, 8*a* (FIGS. 1 and 2) are insertable to block off the channel or a channel portion from other channels or channel portions. Alternatively, the plugs 8, 8*a* are removable from the sockets 9 to effect communication of adjacent channels or channel portions. Plugs 8, 8*a* are inserted in or removed from appropriate sockets 9 by removing the plate 7 and the seal 6 and then replacing them. Means (not shown) may be provided to hold the plate 7 firmly on the base-plate 4. Instead of a continuous sheet seal 6, the sealing may be effected by placing deformable strips around the upper edges of the channels or by using appropriately-shaped gaskets. By appropriate positioning of plugs 8, 8*a* communication between two channels or channel portions can be effected or adjacent channels or channel portions can be cut-off from one another according to the fluid circuit required. The orifices 11 are conveniently arranged in groups and in columns as shown in FIG. 4 so as to provide for the connection of logical component elements or modules, such as 10, with the channels to create different logical functions. For example, in FIG. 4 the logical element 10 there shown is a NOR element and has an output orifice Q and three control orifices $x$, $y$, $z$ to be connected in a logical circuit complying with the equation $Q = x + y + z$.

Figure 5:
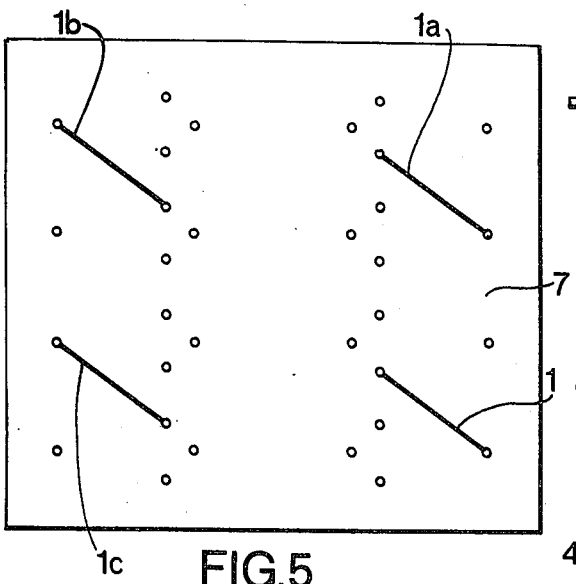
FIG. 5 is a schematic view of a circuit corresponding to four OR-INHIBITION functions, using the device shown in FIGS. 1 to 3.
Figure 6:
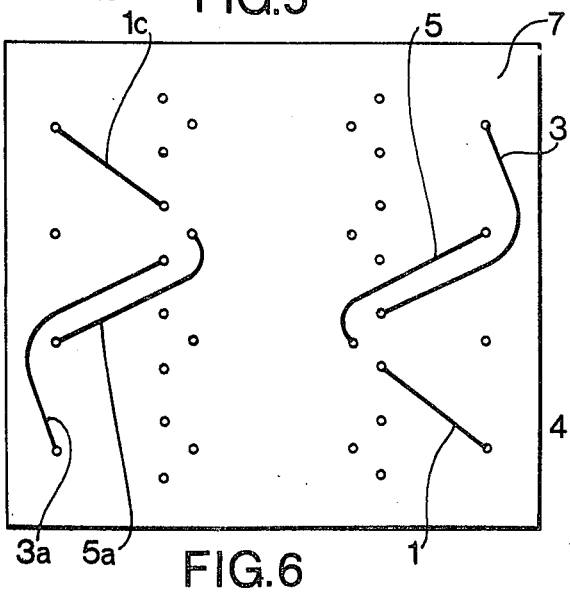
FIG. 6 is a schematic view of a circuit corresponding to two AND functions, using the device shown in FIGS. 1 to 3.

FIG. 5 illustrates an alternative mode in which the plugs 8, 8*a* of the four conduits 1, 1*a*, 1*b*, 1*c* have been removed thus allowing the creation of four OR-INHIBITION functions. FIG. 6 illustrates yet another mode in which the plugs 8, 8*a* of the conduits 1, 3, 5 and 1*c*, 3*a*, 5*c* have been removed thus allowing the creation of two AND functions.

Figure 1:
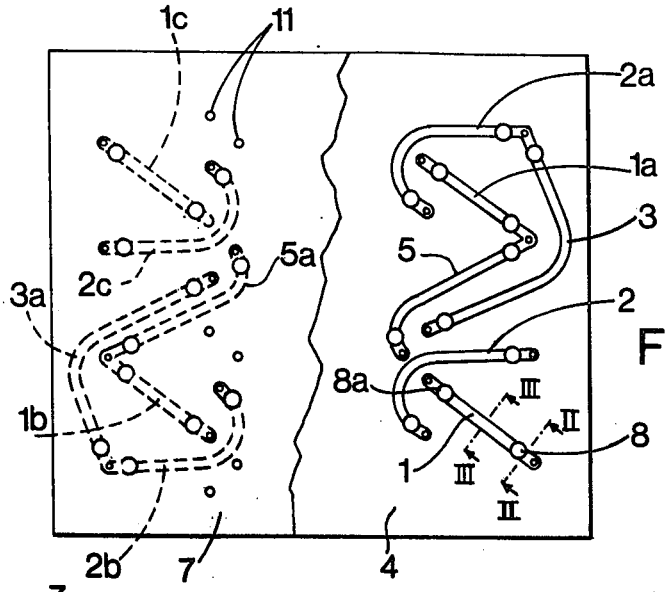
FIG. 1 is a plan view of the device.

Other functions can also be created in a similar way with the device illustrated in FIGS. 1, 2 and 3, particularly the logical functions: NO, YES, products of sums, and FLIP-FLOP.

The device provided by the present invention is not limited to the provision of logical circuits and can also be applied to any type of circuit, such as power circuits.

It should be noted that the device may comprise more than one layer comprising a base-plate 4, seal and plate 7, thereby to provide additional circuit configurations, particularly to enable the crossing of circuits to be produced.

Figure 7:
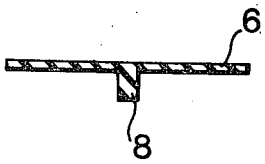
FIG. 7 is a sectional view of a seal similar to FIG. 2 but showing a mode function thereof.

FIG. 7 shows a modification in which a plug 8 is integral with or permanently secured to the seal 6 or a seal portion, instead of using separate plugs 8 and a seal 6 as in FIGS. 1 to 3.

Figure 8:
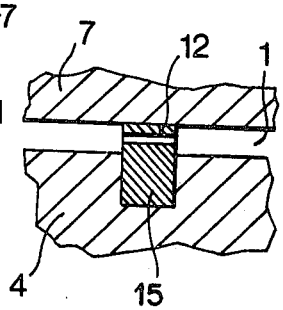
FIG. 8 is a sectional view of an alternative plug forming a resistance.
Figure 9:
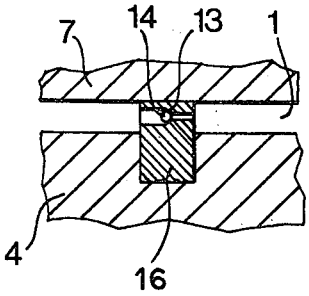
FIG. 9 is a sectional view of yet another plug forming a valve.

The plugs 8, 8*a* may themselves constitute fluidic components. For example, FIG. 8 illustrates a resistance formed by a plug 15 having a restricting conduit 12 therein and FIG. 9 illustrates a non-return valve formed by a plug 16 having a valve seal 13 therein fitted with a ball valve 14.

Other types of fluidic components equivalent to electrical components such as diodes, capacitances, or the like may be formed as so connected to the plugs 8, 8*a*.

What I claim as my invention and desire to secure by Letters Patent of the United States is;

1. A universal circuit-defining device with which logical or other component elements or modules of component elements are to be connected, the device including a base plate having opposed faces, open channels provided in one of said opposed faces and sockets formed in said open channels, a deformable seal engaging said one face and by which said open channels are closed, and a cover plate by which said deformable seal is held against said one face, said channels constituting pre-established circuit elements, the device also including interchangeable plugs constituting means for the interruption of the circuit and insertable in and removable from said sockets, said plugs removable to bring corresponding parts of the circuit into operation.

2. A device according to claim 1 in which said interchangeable plugs are integral with said seal.

3. A device according to claim 1 in which a plug itself also constitutes a fluid logical component element equivalent to an electrical element such as a diode, resistor and capacitor.

4. A device according to claim 1, having in said cover plate a plurality of alternative input and control orifices to which the logical or other component elements or modules of component elements are connectable.

* * * * *

UNITED STATES PATENT AND TRADEMARK OFFICE

CERTIFICATE OF CORRECTION

PATENT NO. : 4,014,364

DATED : March 29, 1977

INVENTOR(S) : Pierre Matrot

It is certified that error appears in the above-identified patent and that said Letters Patent are hereby corrected as shown below:

Col. 3, line 1, delete 5c and insert --5a--

Signed and Sealed this

Twenty-first Day of June 1977

[SEAL]

*Attest:*

RUTH C. MASON
*Attesting Officer*

C. MARSHALL DANN
*Commissioner of Patents and Trademarks*